US008414097B2

(12) United States Patent
Sasaki

(10) Patent No.: US 8,414,097 B2
(45) Date of Patent: Apr. 9, 2013

(54) IMAGE FORMING APPARATUS SELECTING PULSES TO FORM DRIVE WAVEFORM

(75) Inventor: Takafumi Sasaki, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 85 days.

(21) Appl. No.: 13/229,859

(22) Filed: Sep. 12, 2011

(65) Prior Publication Data

US 2012/0069071 A1 Mar. 22, 2012

(30) Foreign Application Priority Data

Sep. 16, 2010 (JP) ..... 2010-207441
Jul. 16, 2011 (JP) ..... 2011-157277

(51) Int. Cl.
*B41J 29/38* (2006.01)

(52) U.S. Cl.
USPC ..... 347/11; 347/10; 347/19

(58) Field of Classification Search ..... 347/5, 10, 347/11, 14, 19
See application file for complete search history.

(56) References Cited

U.S. PATENT DOCUMENTS 6,174,038 B1 1/2001 Nakazawa et al.
6,193,346 B1 2/2001 Nakano
6,257,689 B1 * 7/2001 Yonekubo ..... 347/11
6,988,782 B2 * 1/2006 Imanaka et al. ..... 347/11
7,410,233 B2 * 8/2008 Kitami et al. ..... 347/11
2008/0111862 A1 5/2008 Sasaki
2009/0009569 A1 1/2009 Sasaki

FOREIGN PATENT DOCUMENTS

JP 09-076534 3/1997
JP 11-034325 2/1999
JP 2001-315332 11/2001
JP 4038598 1/2008
JP 2008-284848 11/2008

* cited by examiner

*Primary Examiner* — Juanita D Jackson
(74) *Attorney, Agent, or Firm* — IPUSA, PLLC

(57) ABSTRACT

An image forming apparatus creates a drive waveform containing a first pulse to discharge the droplet and a second pulse to cause a liquid to flow within a recording head. A data creation part creates data to select a first or second droplet discharge pulse. The first droplet discharge pulse contains the first pulse and the second pulse. The second droplet discharge pulse does not contain the second pulse. When the first or second droplet discharge pulse is selected in a subsequent drive period and when neither the first nor second droplet discharge pulse is selected in a current drive period, the second pulse is selected in the current drive period when selecting the second droplet discharge pulse in the subsequent drive period, and the second pulse is not selected in the current drive period when selecting the first droplet discharge pulse in the subsequent drive period.

7 Claims, 13 Drawing Sheets

IMAGE FORMING APPARATUS SELECTING PULSES TO FORM DRIVE WAVEFORM

BACKGROUND OF THE INVENTION

1. Field of the Invention

The present invention relates to an image forming apparatus and, more particularly, to an image forming apparatus having a recording head which discharges liquid droplets.

2. Description of the Related Art

An ink-jet recording apparatus is used as an image forming apparatus incorporated in a printer, a facsimile machine, a copy machine, a plotter or a multi-function peripheral (MFP). The inkjet recording apparatus is known as an image forming apparatus of a liquid discharge recording system using a recording head which can discharge ink droplets. The image forming apparatus of a liquid discharge recording system performs image-formation by discharging ink droplets from a recording head toward a recording paper while the recording paper is moved. Here, the term "image-formation" includes meanings of recording, letter-printing, photo-printing and printing. There are two types of image forming apparatus having a recording head to discharge ink droplets, one is a serial-type image forming apparatus and the other is a line-type image forming apparatus. The serial-type image forming apparatus forms an image by a recording head discharging liquid droplets while the recording head is moved in a main-scanning direction. The line-type image forming apparatus forms an image by discharging liquid droplets from a recording head in a state where the recording head is not moved.

In this specification, the term "image forming apparatus" means an apparatus to perform an image-formation by causing ink droplets to land on a medium such as paper, string, fiber, cloth, leather, metal, plastic, glass, wood, ceramics, etc. The term "image-formation" means not only producing an image having characters or graphics onto a medium but also producing an image having no meaning such as a pattern. The term "ink" is not limited to a general meaning of ink, and is used as an all-inclusive term for liquid which can form an image, such as a recording liquid, a fixation processing liquid, a liquid, and a liquid resin. The term "recording paper" is not limited to a general meaning of paper, and includes an OHP sheet and a cloth. The term "recording paper" is used as an all-inclusive term which encompasses a medium to be recorded, a recording medium, a recording paper, a paper for recording, etc. The term "image" is not limited to a planar matter, and includes an image given to a stereoscopically-formed matter or an image formed in a three-dimensional shape.

There is known an image forming apparatus, which creates a plurality of drive pulses (discharge pulses) to discharge liquid droplets within one drive cycle in a time-series manner and outputs the drive pulses as a common drive waveform; when creating relatively large dot, two or more pulses are selected to discharge a plurality of liquid droplets and cause the plurality of liquid droplets to be combined in one while the liquid droplets are flying, which results in creation of a dot having a size of a plurality of liquid droplets; and a non-discharge pulse, which drives a head without discharging liquid droplets, is included in the common drive waveform in order to discharge liquid droplets stably by selecting the non-discharge pulse to perform a fine drive.

For example, Japanese Laid-Open Patent Application No. 2001-315332 (Patent Document) discloses a drive method of an ink-jet printer, which comprises a plurality of nozzles for discharging ink droplets, and a pressure generating means provided to each nozzle for applying a pressure to ink in each nozzle, wherein printing is performed while moving a recording paper relative to the nozzles. According to this drive method, a first voltage pulse and a second voltage pulse are applied to the pressure generating means given an instruction to discharge ink droplets in synchronization with a reference signal, the first voltage pulse having amplitude by which ink droplets can be discharged, and the second voltage pulse causing ink inside the nozzle to flow within the nozzle. The second voltage pulse is applied to the pressure generating means corresponding to the nozzle which is not provided with an instruction of discharging ink droplets (the nozzle of which passed time or passed reference signal number from ink discharge of last time is equal to or greater than a threshold value) in order to attempt a reduction in power consumption.

However, the structure disclosed in the above-mentioned Patent Document does not sufficiently reduce power consumption. For example, a typical text (character) document has a printed area, which is 5% to 10% of the entire area of the document and the rest of the area is blank in many cases. When printing such an image by an inkjet recording apparatus having a plurality of nozzles, there are nozzles that do not discharge liquid droplets at all.

Therefore, according to the structure disclosed in the above-mentioned Patent Document, where a minute drive pulse is applied in a condition depending on only a discharge state of a nozzle before a current drive cycle (reference signal), that is, a condition where droplet discharge is not performed during a predetermined time period or a predetermined drive cycle, even if the number of times may be reduced in the above-mentioned case, a minute drive pulse is still applied, which results in a wasteful consumption of electric power.

SUMMARY OF THE INVENTION

It is a general object of the present invention to provide an image forming apparatus in which the above-mentioned problems are eliminated.

A more specific object of the present application is to provide an image forming apparatus which can reduce power consumption while maintaining good discharge stability.

In order to achieve the object, there is provided according to one aspect of the present invention an image forming apparatus comprising: a recording head having a nozzle to discharge a liquid droplet; a drive waveform creation part configured to create and output a drive waveform containing a first pulse and a second pulse on an individual drive period basis, the first pulse causing the liquid droplet to be discharged from the nozzle, the second pulse causing a liquid in the recording head to flow within the recording head without causing the droplet to be discharged; and a data creation part configured to create data to select a first droplet discharge pulse or a second droplet discharge pulse when causing the recording head to discharge the liquid droplet, the first droplet discharge pulse containing the first pulse and the second pulse, the second droplet discharge pulse containing the first pulse but not containing the second pulse, wherein, when the first droplet discharge pulse or the second droplet discharge pulse is selected in a subsequent drive period and when neither the first droplet discharge pulse nor the second droplet discharge pulse is selected in a current drive period, the data creation part selects the second pulse in the current drive period when selecting the second droplet discharge pulse in the subsequent drive period, and does not select the second pulse in the current drive period when selecting the first droplet discharge pulse in the subsequent drive period.

There is provided according to another aspect of the invention an image forming apparatus comprising: a recording head having a nozzle to discharge a liquid droplet; a drive waveform creation part configured to create and output a drive waveform containing a first pulse and a second pulse on an individual drive period basis, the first pulse causing the liquid droplet to be discharged from the nozzle, the second pulse causing a liquid in the recording head to flow within the recording head without causing the droplet to be discharged; and a data creation part configured to create data to select a first droplet discharge pulse or a second droplet discharge pulse when causing the recording head to discharge the liquid droplet, the first droplet discharge pulse containing the first pulse and the second pulse, the second droplet discharge pulse containing the first pulse but not containing the second pulse, wherein, when the second droplet discharge pulse is selected in a subsequent drive period and when neither the first droplet discharge pulse nor the second droplet discharge pulse is selected in a current drive period, the data creation part compares a time interval, which is from an immediately preceding discharge until the second droplet discharge pulse following the immediately preceding discharge, with a threshold value previously determined as a time interval by which a normal discharge is performed, and determines whether to select the second pulse based on a result of comparison in order to create data to select the second pulse or not select the second pulse in accordance with the result of comparison.

Other objects, features and advantages of the present invention will become more apparent from the following detailed description when read in conjunction with the accompanying drawings.

DETAILED DESCRIPTION OF THE PREFERRED EMBODIMENTS

Figure 1:
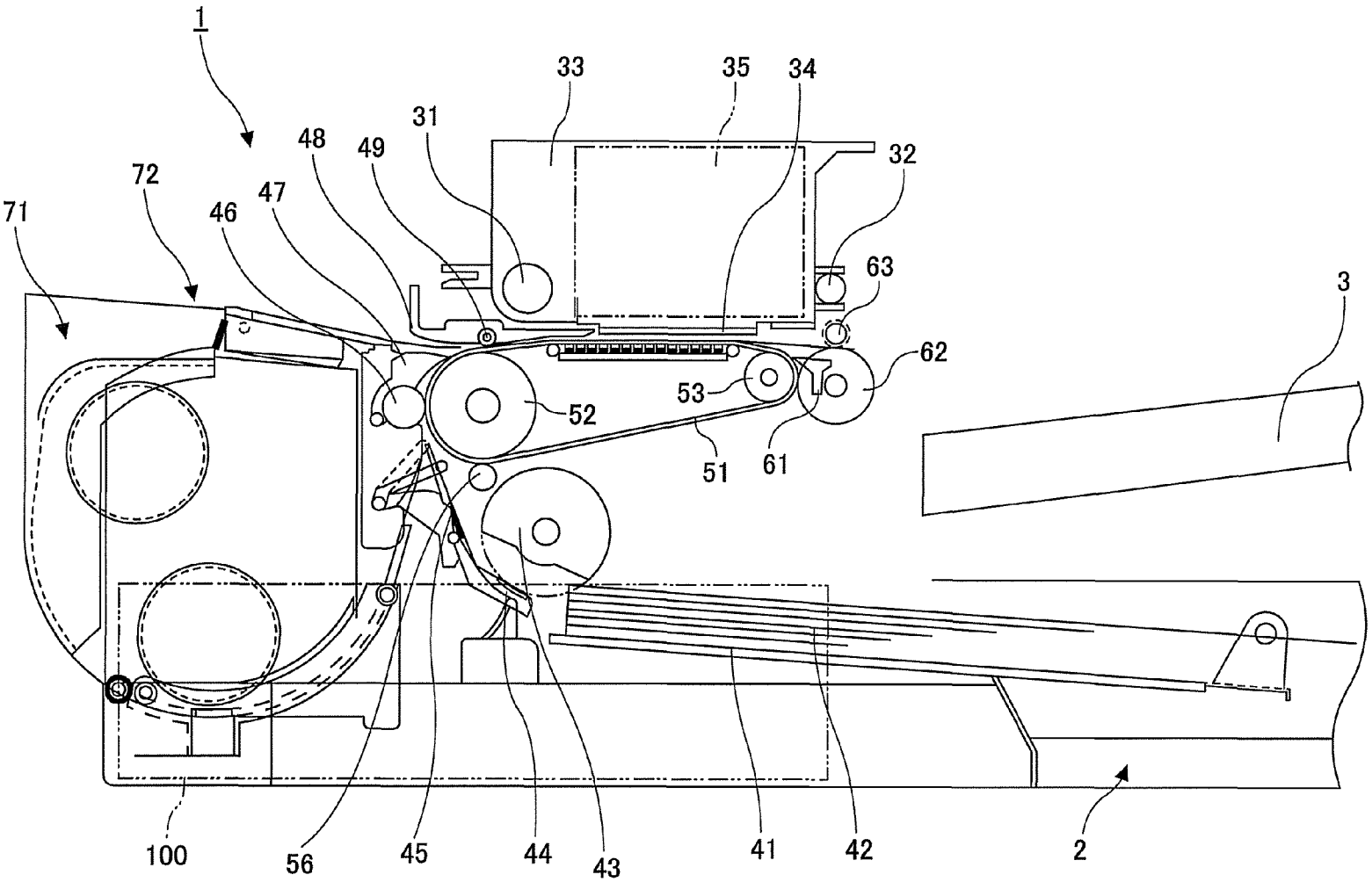
FIG. 1 is a side view of an inkjet recording apparatus according to an embodiment of the present invention.
Figure 2:
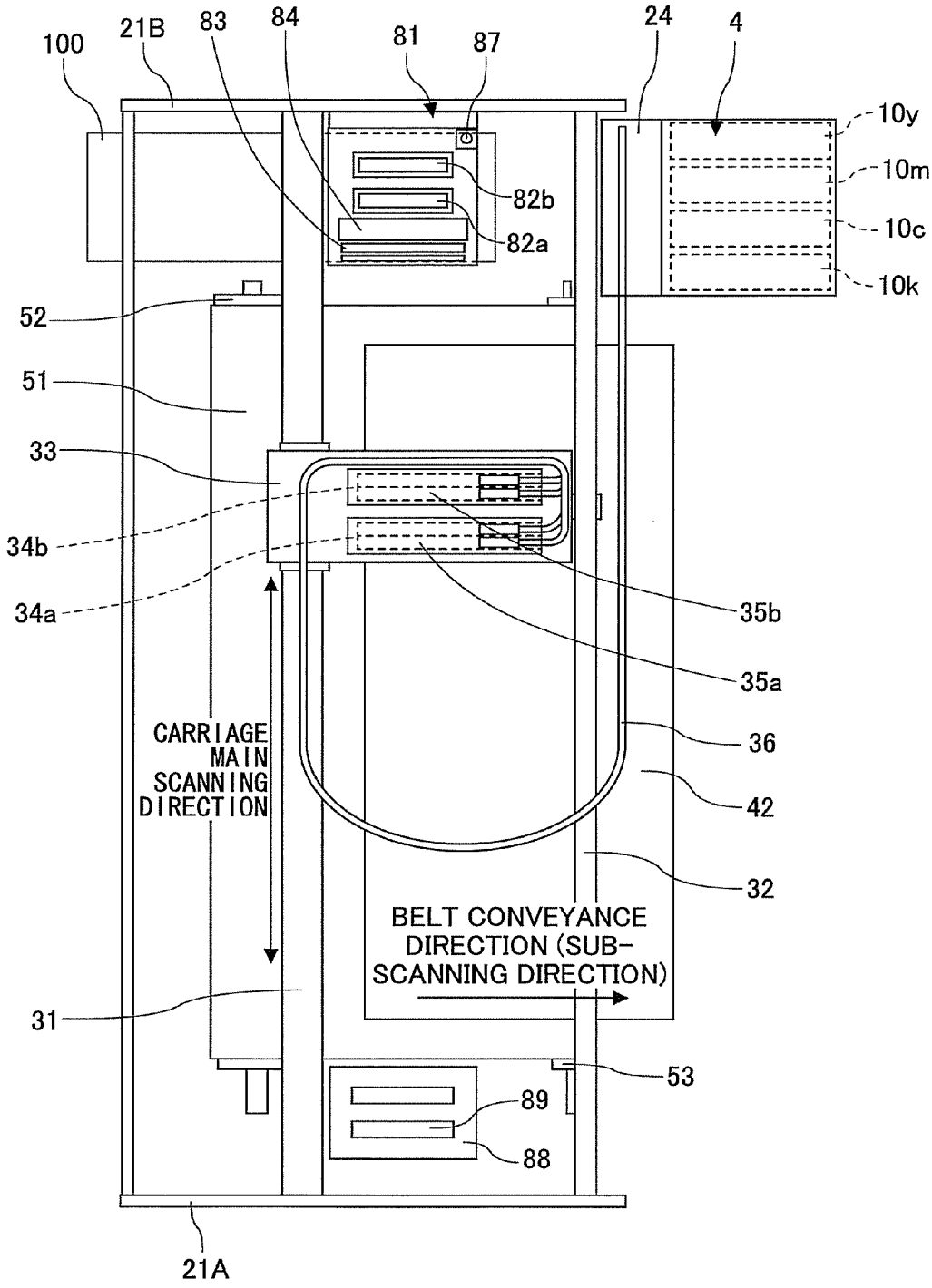
FIG. 2 is a plan view of the inkjet recording apparatus illustrated in FIG. 1.

A description will be given below, with reference to the drawings, of embodiments of the present invention. First, a description will be given, with reference to FIG. 1 and FIG. 2, of an example of an image forming apparatus according to the present invention. FIG. 1 is a side view of an inkjet recording apparatus according to an embodiment of the present invention. FIG. 2 is a plan view of the inkjet recording apparatus illustrated in FIG. 1.

The image forming apparatus illustrated in FIGS. 1 and 2 is a serial-type inkjet recording apparatus, which has a frame including left and right side plates 21A and 21B. A carriage 33 is supported slidably in a main scanning direction by a main guide rod 31 and a sub-guide rod 32 that are guide members bridged between the side plates 21A and 21B. The carriage 33 is movable by a main scanning motor (not illustrated in the figures) through a timing belt (not illustrated in the figure) in a direction (carriage main scanning direction) indicated by an arrow in FIG. 2.

As illustrated in FIG. 2, recording heads 34*a* and 34*b*, each including a liquid droplet discharge head discharging ink droplets of yellow (Y), cyan (C), magenta (M) or black (Bk), are provided in the carriage 33. Hereinafter, each of the recording heads 34*a* and 34*b* may be referred to as a recording head 34. The recording head 34 has a plurality of nozzles aligned in a sub-scanning direction perpendicular to a main scanning direction so that an ink droplet discharge direction is incident on a vertically downward direction.

Each of the recording heads 34*a* and 34*b* has two nozzle trains. The nozzles of one of the nozzle trains of the recording head 34*a* discharge liquid droplets of black (K), and the nozzles of the other of the nozzle trains of the recording head 34*a* discharge liquid droplets of cyan (C). The nozzles of one of the nozzle trains of the recording head 34*b* discharge liquid droplets of magenta (M), and the nozzles of the other of the nozzle trains of the recording head 34*b* discharge liquid droplets of yellow (Y). It should be noted that the recording head 34 may have a plurality of nozzle trains of each color in a single nozzle surface.

Sub-tanks 35*a* and 35*b* for each color to supply each color ink to the nozzle trains of the recording head 34 are mounted as a second ink supply part on the carriage 33. Each of the sub-tanks 35*a* and 35*b* may be referred to as a sub-tank 35. a recording liquid (ink) of each color is supplied from ink cartridges (main tank) 10*k*, 10*c*, 10*m* and 10*y*, which are attached to a cartridge holder serving as a cartridge attaching part, to the sub-tanks 35 through ink supply tubes 36 by a supply pump unit 24.

A paper supply part feeds papers 42 stacked on a paper stacking part (pressure plate) 41 of a paper supply tray 2. The paper supply part includes a paper supply roller (half-moon roller) 43 and a separation pad 44 facing the paper supply roller 43. The half-moon roller 43 separates and feeds the papers 42 one after another from the paper stacking part 41. The separation pad 44 is made of a material having a large friction coefficient, and is urged toward the paper supply roller 43.

A guide member 45, a counter roller 46, a conveyance guide member 47 and a press member 48 are provided to convey the papers 42 supplied from the paper supply part to a position under the recording heads 34. The guide member 45 guides the papers 42. The press member 48 has an end pressure roller 49. A conveyance belt 51, which is a conveyance means, conveys the papers 42 to a position facing the recording heads 34 by electro-statically attracting the papers 42 thereto.

The conveyance belt 51 is an endless belt, which is engaged between a conveyance roller 52 and a tension roller 53 to rotate in a belt conveyance direction (sub-scanning direction). The inkjet recording apparatus 10 is equipped with a charge roller 56, which is a charge part to charge a surface of the conveyance belt 51. The charge roller 56 is arranged to contact with the surface of the conveyance belt 51 and is rotated in association with a rotation of the conveyance belt 51. The conveyance belt 51 is rotated in a belt conveyance direction indicated by an arrow in FIG. 2 by the conveyance roller being rotationally driven by a sub-scanning motor (not illustrated in the figure) through a timing belt.

A separation claw 61 and paper eject rollers 62 and 63 together form a paper eject part to eject the paper 42 on which an image has been formed by the recording heads 34. The separation claw 61 separates the paper 42 from the conveyance belt 51, and the separated paper 42 is conveyed by being caught between the paper eject rollers 62 and 63. A position between the paper eject rollers 62 and 63 is considerably higher than the paper eject tray 3 so that a large number of papers 42 can be accommodated in the paper eject tray 3.

A both-side unit 71 is detachably attached to a rear side part of the apparatus body of the inkjet recording apparatus 1. The paper 42, which is returned by a reverse rotation of the conveyance belt 51, enters the both-side unit 71. The paper 42 in the both-side unit 71 is inverted and fed to the position between the counter roller 46 and the conveyance belt 61. An upper surface of the both-side unit 71 is configured to serve as a manual paper feed tray 72.

Furthermore, a maintenance and recovery mechanism 81 is arranged in a non-printing area on one side in the scanning direction of the carriage 33. The maintenance and recovery mechanism 81 includes cap members 82*a* and 82*b* (each may be referred to as a cap 82), a wiper blade 83 and an ink receiver 84. The cap 32 is provided to cap the nozzle surface of each of the recording heads 34. The wiper blade 83 is a blade member for wiping the nozzle surfaces of the recording heads 34. The ink receiver 84 receives droplets of ink ejected by a so-called empty discharge, which is performed to discharge ink (recording liquid) of which viscosity is increased. A waste liquid tank 100 is detachably attached to the apparatus body under the waste and recovery mechanism 81. The waste liquid tank stores a waste liquid generated by the maintenance and recovery operation.

An ink receiver 88 is arranged in a non-printing area on the opposite side in the scanning direction of the carriage 33. The ink receiver 88 receives droplets of ink ejected by an empty discharge, which is performed to eject droplets of ink of which viscosity has been increased during recording and which do not contribute to the recording. The ink receiver 88 is provided with openings 89 arranged along the aligning direction of the recording heads 34.

In the inkjet recording apparatus 1 having the above-mentioned structure, the papers 42 are separated and fed one by one from the paper supply tray 2 and the papers 42 are fed vertically upward. Then, the papers 42 are guided by the guide member 45 to a position between the conveyance belt 51 and the counter roller 46. The papers 42 are pinched between the conveyance belt 51 and the counter roller 47, and are pressed onto the conveyance belt 51 by the end pressure roller 49 to change the conveyance direction by about 90 degrees.

At this state, an alternating voltage is applied from an AC bias supply part to the charge roller 56 to charge the surface of the conveyance belt 51. Specifically, an alternating voltage of a plus and a minus is applied to the conveyance belt 51 so that the conveyance belt 51 is charged in a charge voltage pattern in which a plus and a minus are alternatively charged with a predetermined width in a rotating direction, which is coincident with the sub-scanning direction. When the papers 42 are fed onto the thus-charged conveyance belt 51, the papers 42 are electro-statically attracted by the conveyance belt 51, and the papers 42 are conveyed in the sub-scanning direction by the travel of the conveyance belt 51.

Then, droplets of ink are discharged onto one of the papers 42 by driving the recording heads 34 in accordance with an image signal while moving the carriage 33 to record a part of an image corresponding to one line. Thereafter, the paper 42 is conveyed by a predetermined distance, and recording a part of the image corresponding to a subsequent line is performed. The recording operation is ended when a recording end signal is supplied or a signal indicating that a trailing edge of the paper 42 reached the recording area is supplied, and the paper 42 is ejected onto the paper eject tray 3.

Then, when performing maintenance and recovery of the nozzles of the recording head 34, the carriage 33 is moved to the side of the maintenance and recovery mechanism 81. In this state, the recording heads 34 are capped by the cap 82 to prevent a discharge failure due to dried ink by maintaining the nozzles in a moisturized state. Additionally, ink is suctioned from the nozzle by a suction pump (not illustrated in the figures) in the state where the recording heads 34 are capped by the cap 82 in order to perform a recovery operation to eject bubbles and ink of which viscosity has been increased. The ink ejected at this time is stored in the waste liquid tank 90. Additionally an empty discharge operation is performed before start recording or during recording. Thereby, the stable discharge performance of the recording heads 34 is maintained, which results in image formation by stable discharge of liquid droplets.

Figure 3:
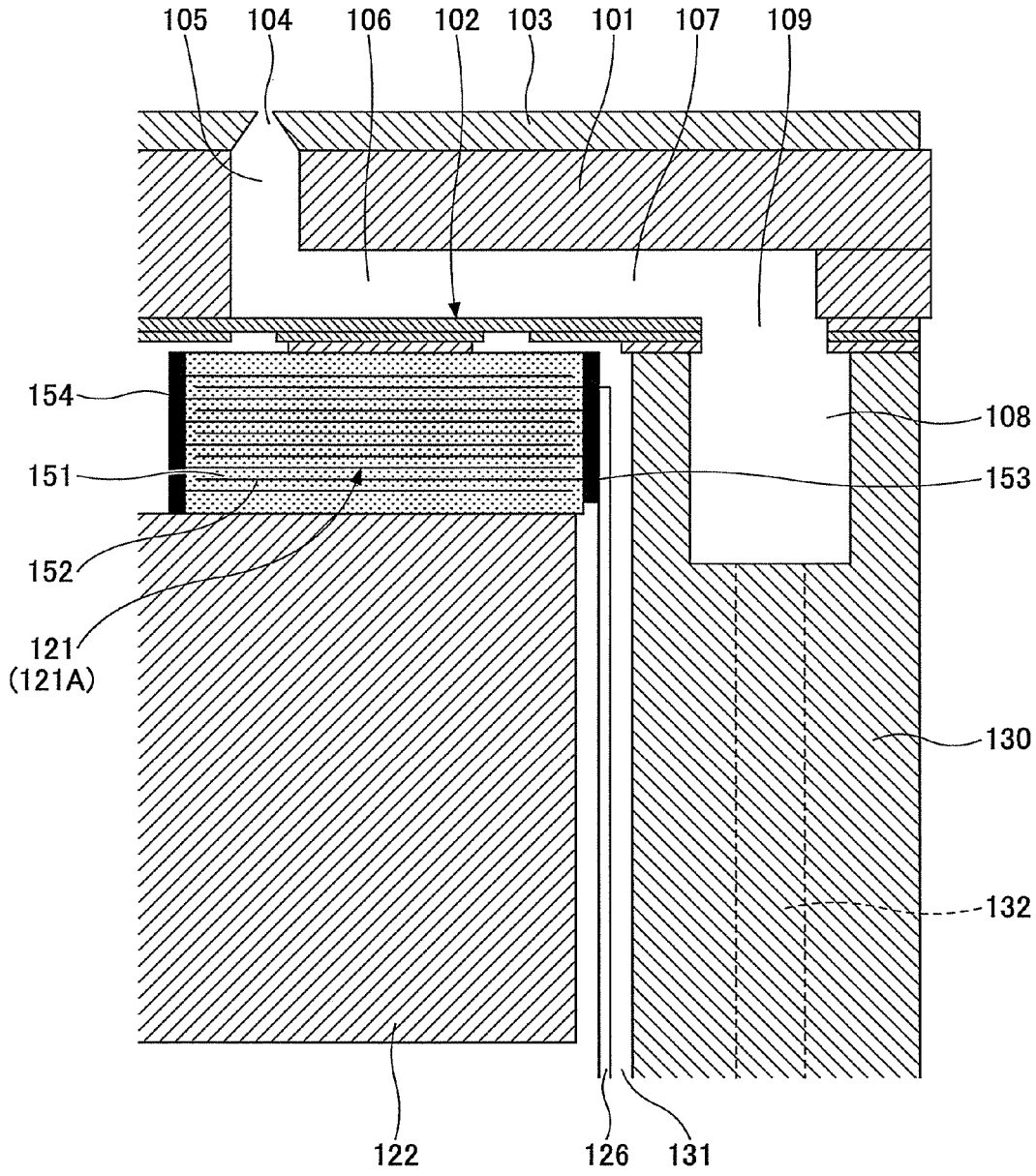
FIG. 3 is a cross-sectional view of a part of a liquid discharge head taken along a longitudinal direction of a liquid chamber.
Figure 4:
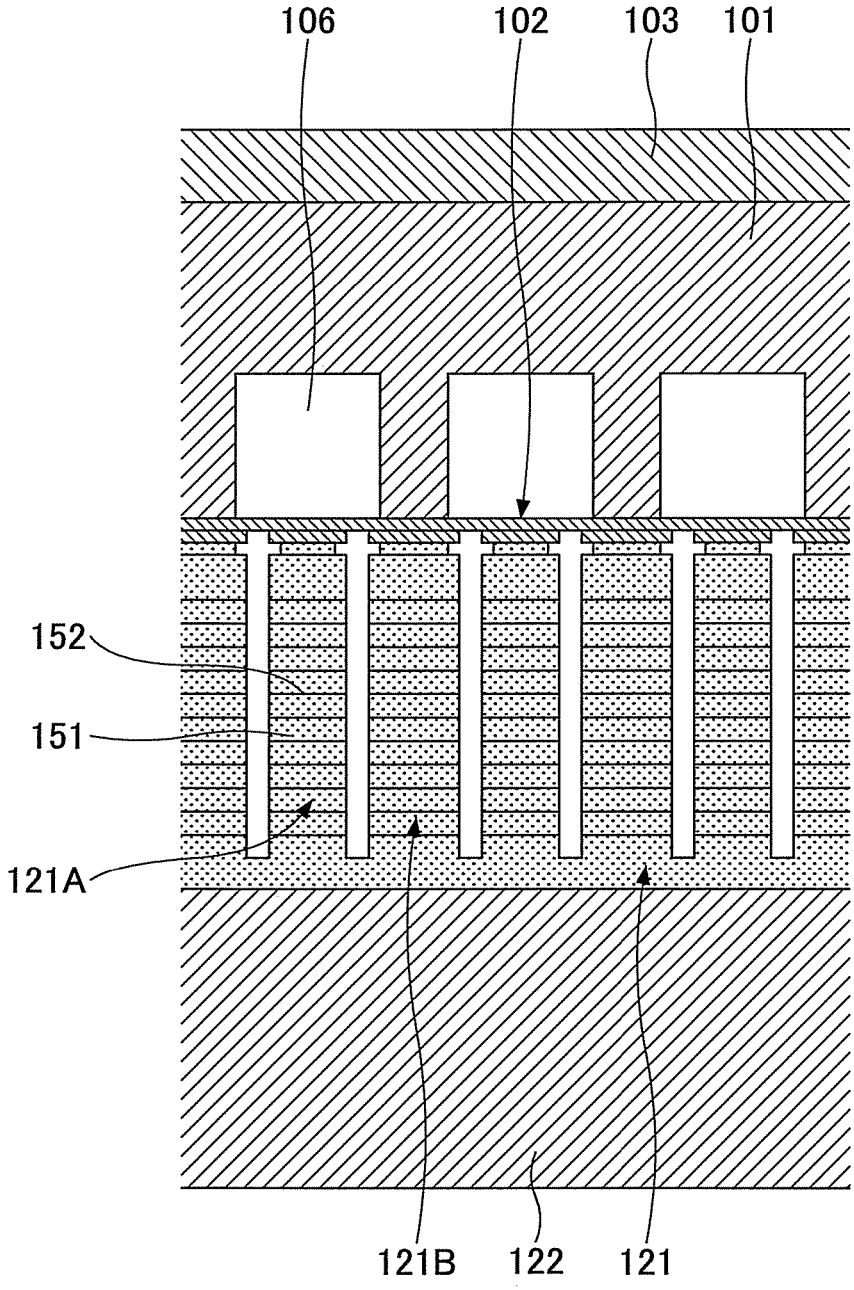
FIG. 4 is a cross-sectional view of a part of the liquid discharge head taken along a transverse direction of the liquid chamber.

A description will be given below, with reference to FIG. 3 and FIG. 4, of an example of the liquid discharge head constituting the recording head 34. FIG. 3 is a cross-sectional view of a part of the liquid discharge head taken along a longitudinal direction of a liquid chamber. FIG. 4 is a cross-sectional view of a part of the liquid discharge head taken along a transverse direction of the liquid chamber.

The liquid discharge head is formed by a flow path plate 101, a vibration plate 102 joined to a bottom surface of the flow path plate 101, and a nozzle plate 103 joined to a top surface of the flow path plate 101. Formed in the liquid discharge head are a nozzle communication path 105 to connect the nozzle 104 through which liquid droplets (ink droplets) are discharged, a pressurizing liquid chamber 106 which is a pressure generating chamber, and an ink supply port 109 which communicates with a common liquid chamber 108 for supplying ink to the liquid chamber 106 through a flow resistance part (supply path) 107.

Then, a peripheral portion of the vibration plate 102 is joined to a frame member 130. The frame member 130 is provided with a penetration part 131, which accommodates an actuator unit including a piezoelectric member 121 and a base plate 122, a concave portion serving as the common liquid chamber 108, and an ink supply hole 132 serving as a liquid supply port for supplying externally to the common liquid chamber 108.

Here, the flow path plate 101 is formed of a single-crystalline silicon substrate of a crystal plane orientation (110). A nozzle communication passage 105 and the liquid chamber 106 are formed in the flow path plate 101 by an anisotropic etching using an alkaline etchant such as a potassium hydrate solution. The material of the flow path plate 101 is not limited to the single-crystalline silicon substrate, and other materials such as a stainless steel or a photosensitive resin may be used as the material of the flow path plate 101.

The vibration plate 102 is formed of a metal plate such as a nickel plate using, for example, an electroforming method. However, other materials such as a metal plate or a joined material of plastic plate and metal may be used. Piezoelectric columns 121A and 121B of a piezoelectric material 130 are bonded to the vibration plate 102, and further the frame member 130 is bonded to the vibration plate 102.

The nozzle plate 103 is provided with the nozzle 104 having a diameter of 10 μm to 30 μm corresponding to each liquid chamber 106. The nozzle plate 103 is bonded to the flow path chamber 106. The nozzle plate 103 is formed of a nozzle formation member of a metal member. A water repellant layer is formed on the outermost surface of the nozzle plate 103 via a necessary layer on the nozzle formation member.

The piezoelectric member 121 is a stacked-type piezoelectric element (here, PZT) in which piezoelectric materials 151 and internal electrodes 152 are stacked alternately. An individual electrode 153 and a common electrode 154 are alternately connected to ends of the internal electrodes 152. Although ink in the liquid chamber 106 is pressurized using a displacement of the piezoelectric material 121 in a d33 direction as a piezoelectric direction in the present embodiment, ink pressurizing structure may be formed using a d31 direction as a piezoelectric direction of the piezoelectric material 121.

In the thus-formed liquid discharge head, the piezoelectric column 121A contracts by decreasing a voltage applied thereto from a reference potential Ve, and, thereby, the vibration plate 102 moves downward which increases a volume of the liquid chamber 106. Thereafter, the piezoelectric column 121A is elongated in a lamination direction by increasing the voltage applied to the piezoelectric column, and, thereby causing the vibration plate 102 to deform toward the nozzle 104, which results in the ink inside the liquid chamber 106 being pressurized and an ink droplet is discharged (ejected) from the nozzle 104.

Then, the vibration plate 102 is returned to an initial position by returning the voltage applied to the piezoelectric column 121A to the reference voltage Ve. Thereby, the volume of the liquid chamber 106 is increased, which creates a negative pressure inside the liquid chamber 106. Thus, ink is supplied from the common liquid chamber 108 to the liquid chamber 106. Then, after the vibration of the meniscus plane of the nozzle 104 attenuates and becomes stable, it is shifted to an operation of discharging the subsequent ink droplet.

It should be noted that a method of driving the liquid discharge head is not limited to the above-mentioned method (pull and push-discharge), and pull-discharge or push-discharge may be performed according to the method of giving a drive waveform.

Figure 5:
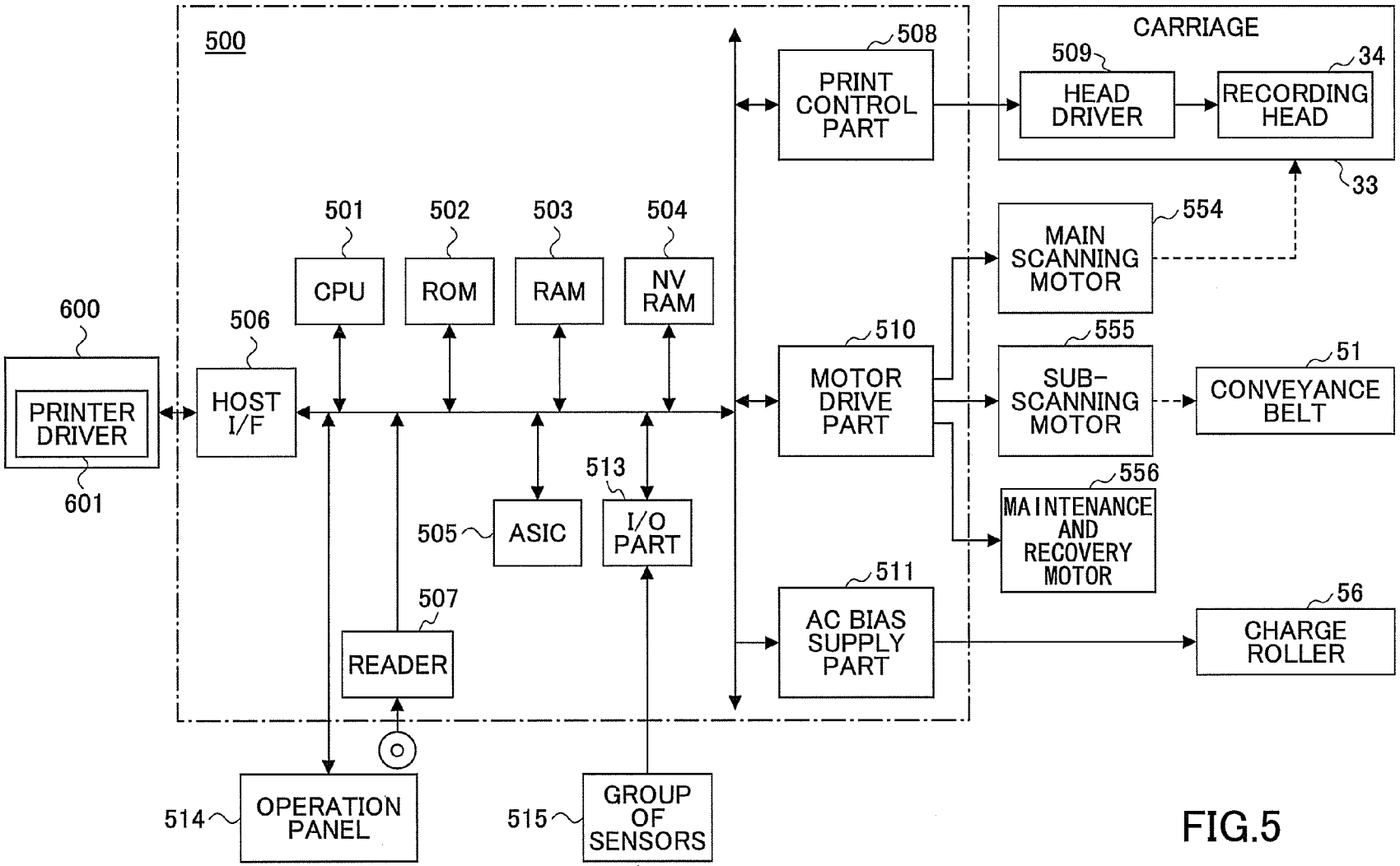
FIG. 5 is a block diagram of the control part 500 of the image forming apparatus.

A description will be given below of an outline of the control part of the image forming apparatus. FIG. 5 is a block diagram of the control part 500 of the image forming apparatus.

The control part 500 includes a CPU 511, a ROM 502, a RAM 503, a rewritable nonvolatile memory (NVRAM) 504, and an ASIC 505. The CPU 501 controls the entire operation of the image forming apparatus. The ROM 502 stores fixed data such as a data creating program according to the present invention and other programs executed by the CPU 501. The RAM 503 temporarily stores image data and other data. The NVRAM 504 retains data while a power of the image forming apparatus is turned off. The ASIC 505 performs various kinds of signal processing on the image data and image processing to perform rearrangement, and also performs processing on input and output signals for controlling the entire apparatus.

The control part 500 also includes a host I/F 506, a reader 507, a print control part 508, a motor drive part 510, an AC bias supply part 511, and an I/O part 513. The host I/F 506 interfaces with a host 600 to exchange data and signals. The reader 507 reads information stored in a recording medium such as an optical disc so that the information such as a program is loaded to the RAM 503. The print control part 508 generates a drive waveform to drive the recording heads 34, and outputs to a head driver (driver IC) 509 image data to selectively drive a pressure generating means of the recording heads 34 and various kinds of data associated with the image data. The motor drive part 510 drives a main scanning motor 554 for moving and scanning the carriage 33, a sub-scanning motor 555 for rotating the conveyance belt 51, and a maintenance and recovery motor 556 for moving the cap 82 and the wiper member 83 of the maintenance and recovery mechanism 81. The AC bias supply part 511 supplied AC bias to the charge roller 56.

The control part 500 is connected to an operation panel 514 to input and display information necessary for operating the image forming apparatus.

The control part 500 receives print data by the host I/F 506 through a cable or a network. The print data is generated by a printer driver 601 of the host 600, which can be an information processing apparatus such as a personal computer, an image reading apparatus such as an image scanner, or an image-taking apparatus such as a digital camera. The print data is received by the I/F 506 through a cable of a network from the host 600.

Then, the CPU 501 of the control part 500 reads the print data in a reception buffer contained in the I/F 506 and analyzes the print data. The ASIC 505 applies a necessary image processing and data rearrangement processing, and transfers the print data from the print control part 508 to the head driver 509. It should be noted that the creation of dot pattern data for outputting an image may be performed by the printer driver 601 of the host 600, or may be performed by the control part 500.

The print control part 508 transfers the above-mentioned image data according to serial data transfer, and outputs a transfer clock, a latch signal and a control signal, which are needed for the transfer of the image data and establishment of the transfer, to the head driver 509. Besides, the print control part 508 includes a D/A converter and a drive signal creation part constituted by a voltage amplifier and a current amplifier in order to output a drive signal including a single drive pulse or a plurality of drive pulses to the head driver 509.

The head driver 509 drives the recording heads 34 by selectively applying drive pulses, which form a drive waveform given by the print control part 508, to the piezoelectric element as the pressure generating means of the recording heads 34 based on the image data (dot pattern data) corresponding to one line of the recording heads 34. When driving the recording heads 34, an entire or a part of the pulses constituting the drive waveform or an entire or a part of a waveform element forming the pulses is selected in order to selectively form dots having different sizes, such as a large droplet, a medium droplet, and a small droplet.

The I/O part 513 acquires information from a group of various sensors 515 incorporated in the image forming apparatus, and extracts information necessary for controlling the print part to use the extracted information in control of the print control part 508, the motor control part 510 and the AC bias supply part 511. The group of sensors 515 include an optical sensor for detecting a position of a recording paper, a thermistor for monitoring a temperature inside the image forming apparatus, a sensor for monitoring a voltage of the charge belt, an interlock switch for detecting opening and closing of a cover. The I/O part 513 is capable of processing information from the various sensors.

Figure 6:
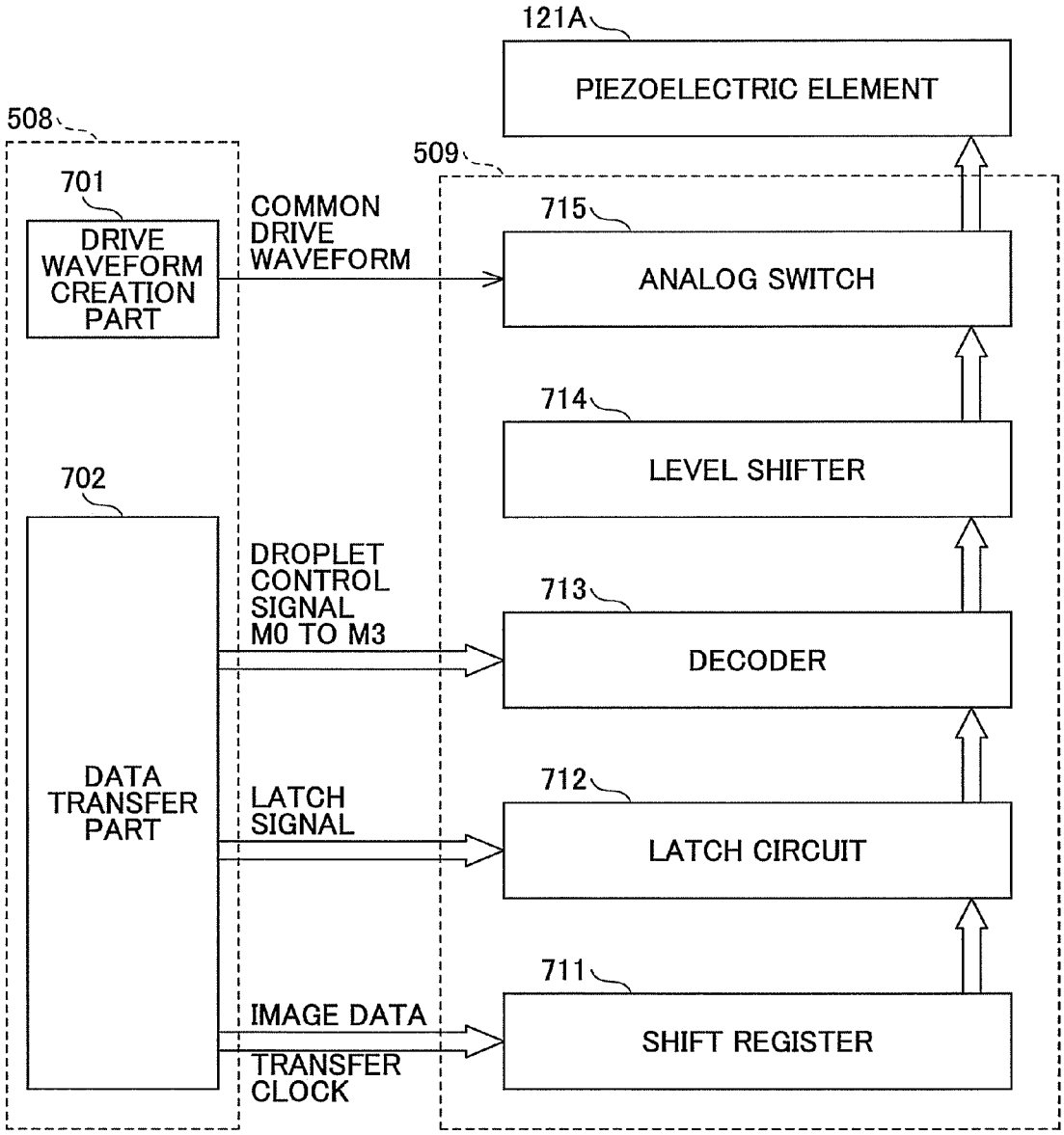
FIG. 6 is a block diagram of a print control part and a head driver.

A description will be given below, with reference to FIG. 6, of an example of the print control part 508 and the head driver 509.

The print control part 508 includes a drive waveform creation part 701 and a data transfer part 702. The drive waveform creation part 701 creates and outputs drive waveform constituted by a plurality of pulses (drive signal) within a single print cycle (one drive cycle) when forming an image. The data transfer part 702 outputs a clock signal, a latch signal (LAT) and droplet control signals M0-M3.

The droplet control signals M0-M3 are two-bit signals for instructing opening and closing of an analog switch 715 of the head driver 509, which is a switch means mentioned later, for each droplet. The droplet control signal transits to an H-level (ON) at a pulse or a waveform to be selected in synchronization with a print cycle of the common drive waveform, and transits to L-level (OFF) when selection is not made.

The head driver 509 includes a shift register 711, a latch circuit 712, a decoder 713, a level shifter 714 and an analog switch 716. The shift register inputs a transfer clock (shift clock) from the data transfer part 702 and serial image data (gradation data: 2 bits/1 channel (1 nozzle)). The decoder 713 decodes the gradation data and the control signals M0-M3 and outputs the results. The level shifter 714 level-changes the level of the logic-level voltage signal to a level at which the analog switch 715 can be operated. The analog switch 716 is turned ON/OFF (open and close) by the output of the decoder 713 given via the level shifter 714.

The analog switch 716 is connected to the selection electrode (individual electrode) 154 of each of the piezoelectric columns 121A, and the common drive waveform from the drive waveform creation part 701 is input to the analog switch 716. Accordingly, the analog switch 715 is turned on in accordance with a result of decoding the serially transferred image data (gradation data) and control signals M0 to M3, and the pulses (or the waveform elements) constituting the common drive waveform are passed through (selected) and are applied to the piezoelectric column 121A.

A description is given below, with reference to FIG. 7, of the drive waveform. The term "drive pulse" means a pulse as an element constituting a drive waveform. The term "discharge pulse" means a pulse applied to the pressure generation means to discharge a liquid droplet. The term "non-discharge pulse" means a pulse which is applied to the pressure generation means but does not cause a droplet to be discharged (ink flows within the nozzle).

The waveform according to the present embodiment is an example which includes discharge pulses causing three sizes of droplets (a large droplet, a medium droplet, a small droplet) to be discharged and a non-discharge pulse for performing a minute drive. A waveform (common drive waveform) Pv illustrated in FIG. 7-(*a*) is output from the drive waveform drive creation part 701. The drive waveform Pv includes drive pulses P1-P4 that are sequentially created in synchronization with the reference signal within one print cycle (one drive cycle). The reference signal is a signal output in response to a position of the carriage 33 in the main scanning direction in accordance with a density of an image to be formed. The drive pulse P1 is a non-discharge pulse (second pulse) and pulses P2-P4 are discharge pulses (first pulses).

Figure 7:
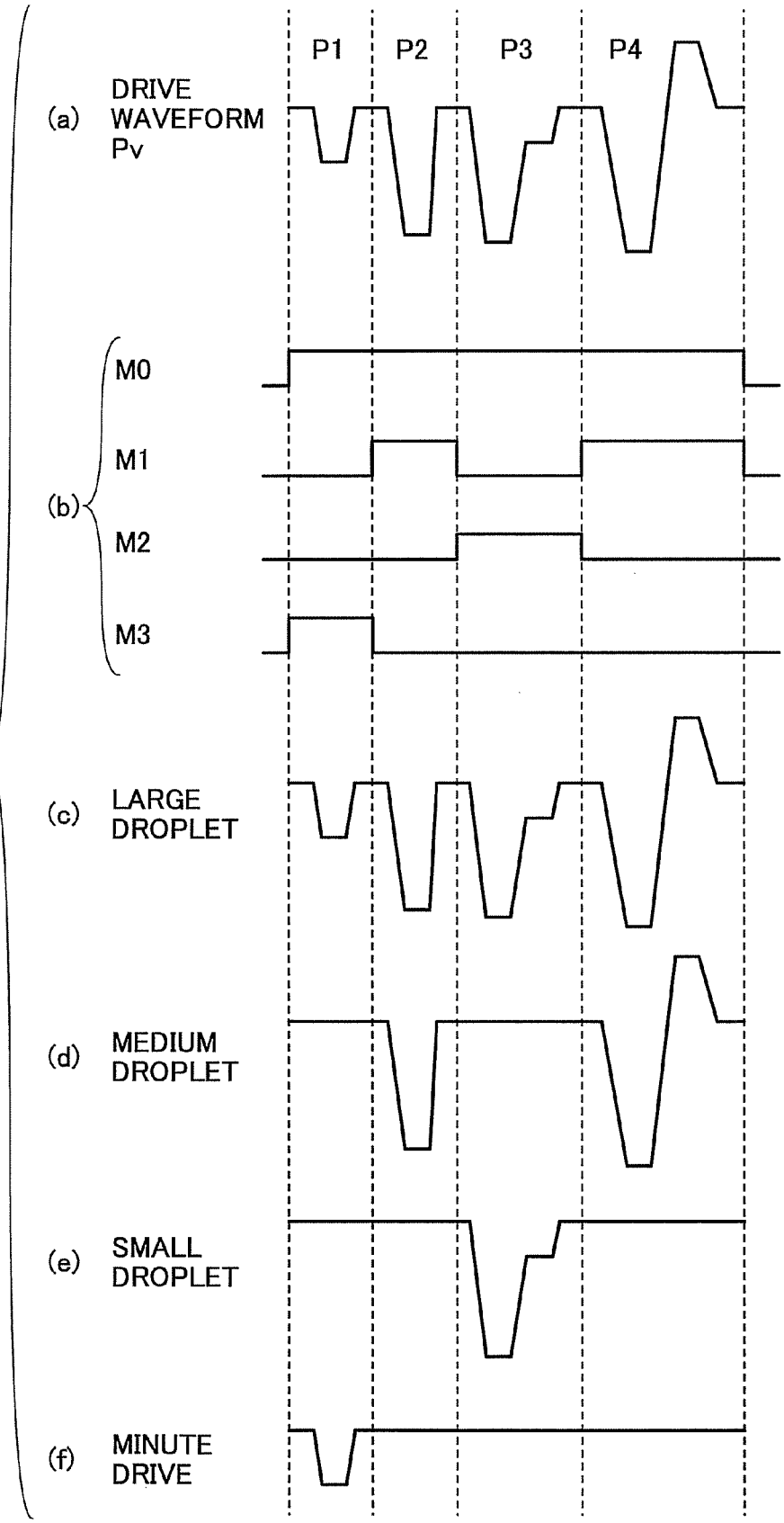
FIG. 7 is a waveform chart for explaining pulses and sizes of droplets.

Then, the droplet control signals M0-M3 illustrated in FIG. 7-(*b*) are output from the data transfer part 702. The droplet control signal M0 selects the drive pulses P1-P4 to create the discharge pulse for a large droplet as illustrated in FIG. 7-(*c*). The droplet control signal M1 selects the drive pulses P2 and P4 to create the discharge pulse for a medium droplet as illustrated in FIG. 7-(*d*). The droplet control signal M2 selects the drive pulses P3 to create the discharge pulse for a small droplet as illustrated in FIG. 7-(*e*). The droplet control signal M3 selects the drive pulses P1 to create the non-discharge pulse for minute drive as illustrated in FIG. 7-(*f*).

That is, in this example, the discharge pulse for large droplet is a first droplet discharge pulse containing drive pulses P2-P4, which are the first pulses, and the non-discharge pulse P1, which is the second pulse; the discharge pulse for medium droplet is a second droplet discharge pulse containing the drive pulses P2 and P4, which are the first pulses, and does not contain the non-discharge pulse P1, which is the second pulse; and the discharge pulse for small droplet is also the second droplet discharge pulse containing the drive pulse P3, which is the first pulse, and does not contain the non-discharge pulse P1, which is the second pulse. A time interval between the drive pulse P1 and the drive pulse P2 is substantially equal to a natural period determined by the pressure chamber, the nozzle and the ink to be discharged, or substantially equal to an integer multiple of the natural period so that a large droplet can be made in larger size efficiently.

Figure 8:
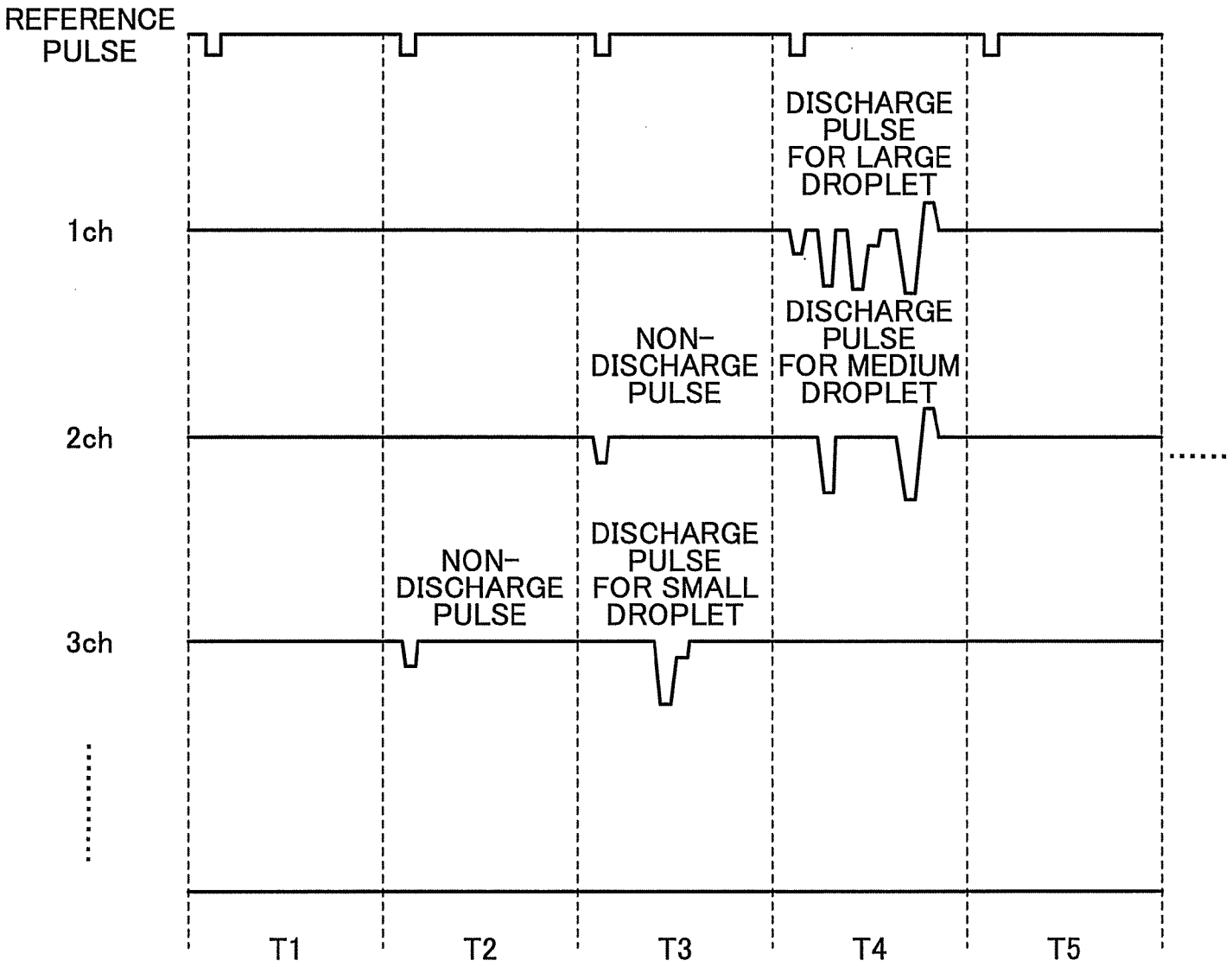
FIG. 8 is a waveform chart illustrating pulses applied in consecutive drive periods according to a first embodiment.

A description will now be given, with reference to FIG. 8, of a first embodiment of the present invention. In FIG. 8, 1ch, 2ch, 3ch, . . . indicate nozzle numbers. The head driver 509 selectively applies the discharge pulses for large, medium and small droplet to each nozzle in synchronization with the reference pulse.

In this example, 1ch applies the discharge pulse for large droplet in a drive period T4, 2ch applies the discharge pulse for medium droplet during the drive period T4, and 3ch applies the discharge pulse for small droplet in a drive period T3. In other words, data to apply such a discharge pulse (the image data and the droplet control signal) is created and provided to the head driver 509 from the data transfer part 702.

Here, with respect to 2ch, assuming that the drive period T3 is a current drive period, because the discharge pulse for medium droplet (second discharge pulse) is applied during the subsequent drive period T4, the non-discharge pulse P1 is applied during the current drive period T3. Similarly, with respect to 3ch, assuming that the drive period T2 is a current drive period, because the discharge pulse for small droplet (second discharge pulse) is applied during the subsequent drive period T3, the non-discharge pulse P1 is applied during the current drive period T2.

Thereby, ink near the nozzle is caused to flow to decrease a viscosity of the ink, of which viscosity has been increased due to the nozzle having been set in a non-discharge state, so that the medium droplet and the small droplet can be discharged in such a state where the viscosity of ink is decreased. Thus, an amount of droplet and a speed of discharging the droplet can be set to target values.

On the other hand, with respect to 1ch, assuming that the drive period is a current drive period, because the discharge pulse for large droplet (first droplet discharge pulse) during the subsequent drive period T4, the non-discharge pulse is not applied during the current drive period T3.

That is, because the discharge pulse for large droplet itself contains the non-discharge pulse, the size of the large droplet is efficiently increased as mentioned above, and a number of the non-discharge pulses (minute drive pulses) can be reduced, thereby attempting electric power reduction.

In this case, the amount of large droplet and discharge speed of the large droplet is given an influence slightly due to the ink near the nozzle having been increased in its viscosity because it has been set in a non-discharge state. However, because the discharge pulse for large droplet contains the minute drive pulse (drive pulse P1) at an initial stage of the drive period, the flow of ink has been performed when the drive pulse P4, which determines the amount of droplet and the discharge speed, is applied, the influence given to the final amount of droplet and discharge speed is suppressed to be small, thereby obtaining a target amount of droplet and discharge speed (a stable discharge characteristic is obtained).

As mentioned above, a further reduction in power consumption can be attempted while maintaining the discharge stability, when selecting the first droplet discharge pulse or the second droplet discharge pulse in a subsequent drive period and selecting neither the first droplet discharge pulse nor the second droplet discharge pulse during the current drive period, by creating data to select the second pulse during the current drive period when selecting the second droplet pulse in the subsequent drive period, and creating data to select no second pulse during the current drive period when selecting the first droplet discharge pulse during the subsequent drive period.

A description is given below, with reference to FIG. 9, of a second embodiment of the present invention.

In this embodiment, with respect to 1ch, two discharge pulses for large droplet are applied consecutively (T2 and T3) and, thereafter, no discharge pulse is applied during the subsequent one drive period (T4), and, thereafter the discharge pulse for large droplet is applied in the subsequent drive period (T5). With respect to 2ch, the discharge pulse for medium droplet is applied (T2) and, thereafter, no discharge pulse is applied during the subsequent two drive periods (T3 and T4), and, thereafter the discharge pulse for medium droplet is applied in the subsequent drive period (T5). With respect to 3ch, two discharge pulses for small droplet are applied consecutively (T2 and T3) and, thereafter, no discharge pulse is applied during the subsequent one drive period (T4), and, thereafter the discharge pulse for small droplet is applied in the subsequent drive period (T5). With respect to 4ch, the discharge pulse for large droplet is applied during one drive period (T1) and, thereafter, no discharge pulse is applied during the subsequent three drive periods (T2, T3 and T4), and, thereafter the discharge pulse for small droplet is applied in the subsequent drive period (T5).

Figure 9:
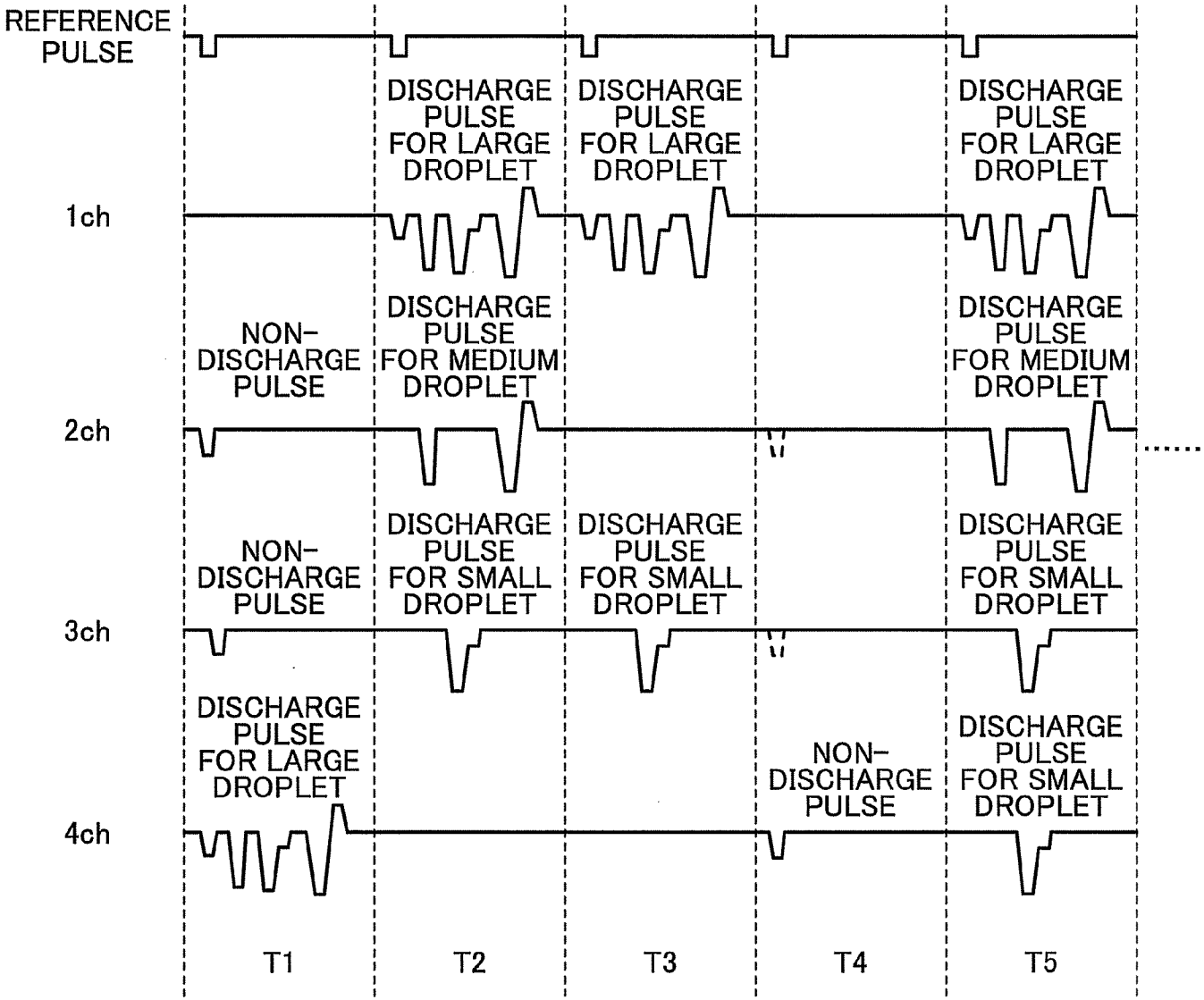
FIG. 9 is a waveform chart illustrating pulses applied in consecutive drive periods according to a second embodiment.

If the above-mentioned first embodiment is applied to the example illustrated in FIG. 9, assuming that a current drive period is the drive period T4, with respect to ch2 and ch3, the non-discharge pulses are applied as illustrated by dashed lines in FIG. 9 because the discharge pulse for medium droplet and the discharge pulse for small droplet, which are the second droplet discharge pulses, are applied during the subsequent drive period T5.

However, in the present embodiment, when the first droplet discharge pulse or the second droplet discharge pulse are selected in a predetermined number of consecutive drive periods before the current drive period (in this case, consecutive three drive periods including the current drive period), data to not select the second discharge pulse is created when selecting the second droplet discharge pulse during the subsequent drive period.

Therefore, assuming that the current drive period is the drive period T4, although the discharge pulse for medium droplet and the discharge pulse for small droplet, which are the second droplet discharge pulses, are applied during the subsequent drive period T5, the non-discharge pulse is not applied as illustrated by solid lines in FIG. 9 with respect to ch2 and ch3. On the other hand, assuming that the current drive period is the drive period T4, with respect to ch4, the non-discharge pulse is applied in the current drive period T4 because the discharge pulse for small droplet, which is the second droplet discharge pulse, is applied during the subsequent drive period T5 and neither the first droplet discharge pulse nor the second droplet discharge pulse is applied during the three (predetermined number of times) drive periods (T2 to T4).

Thereby, it can be attempted to further reduce electric power consumption. It should be noted that if a time from the last discharge is equal to or shorter than a fixed time (predetermine number of drive periods), there is less influence to the image quality as a result even if the minute drive pulse is not applied because a change in the discharge characteristic due to an increase in the viscosity of ink is within an allowable range.

Although the minute drive pulse is applied immediately before the discharge only when discharge is not performed for consecutive three drive periods in the above-mentioned example, the number of consecutive drive periods is not limited to three (3). Additionally, the number of minute drive pulses may be reduced as many as possible within a range where there is no influence to the image quality in consideration of a physical property of ink used and a characteristic of the head. Further, the number of drive periods during which the minute drive pulse is applied may be changed depending on an environmental condition, such as temperature and humidity, of the image forming apparatus.

Figure 10:
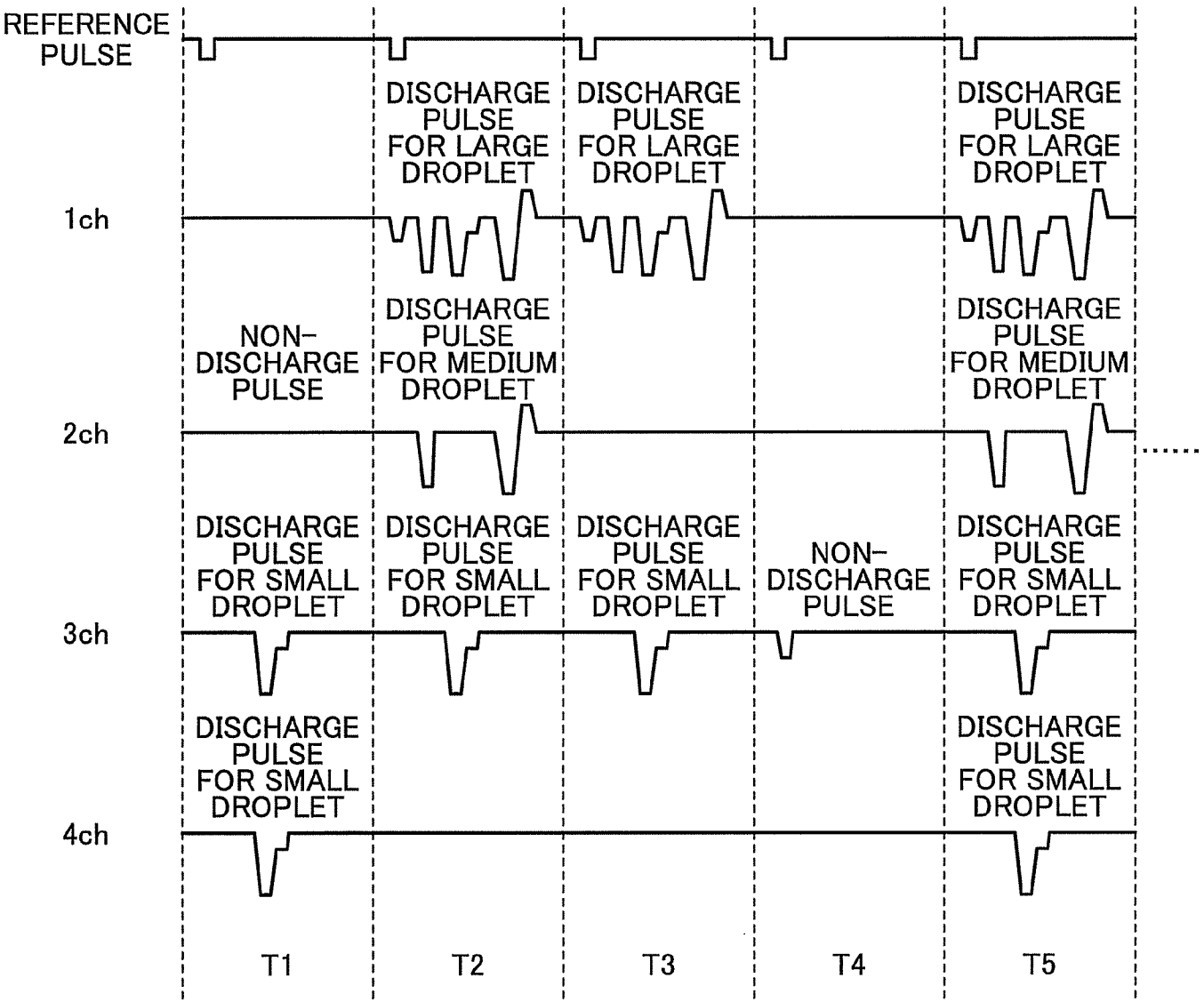
FIG. 10 is a waveform chart illustrating pulses applied in consecutive drive periods according to a third embodiment.

A description is given below, with reference to FIG. 10, of a third embodiment of the present invention.

In the present embodiment, with respect to 1ch, two discharge pulses for large droplet are applied consecutively (T2 and T3) and, thereafter, no discharge pulse is applied during the subsequent one drive period (T4), and, thereafter the discharge pulse for large droplet is applied in the subsequent drive period (T5). With respect to 2ch, the discharge pulse for medium droplet is applied (T2) and, thereafter, no discharge pulse is applied during the subsequent two drive periods (T3 and T4), and, thereafter the discharge pulse for medium droplet is applied in the subsequent drive period (T5). With respect to 3ch, two discharge pulses for small droplet are applied consecutively (T2 and T3) and, thereafter, no discharge pulse is applied during the subsequent one drive period (T4), and, thereafter the discharge pulse for small droplet is applied in the subsequent drive period (T5). With respect to 4ch, the discharge pulse for small droplet is applied during the drive period (T1) and, thereafter, no discharge pulse is applied during the subsequent three drive periods (T2, T3 and T4), and, thereafter the discharge pulse for small droplet is applied in the subsequent drive period (T5).

In this embodiment, with respect to 3ch and 4ch, assuming that a current drive period is the drive period T4, the discharge pulse for small droplet, which is the second droplet discharge pulse, is applied during the subsequent drive period T5. At this time, although the non-discharge pulse is applied during the drive period T4 immediately before discharging the last droplet in 3ch, the non-discharge pulse is not applied during the drive period T4 immediately before discharging the last droplet in 4ch.

Here, when the second droplet discharge pulse is selected in the subsequent drive period, and neither the first droplet discharge pulse nor the second droplet discharge pulse is selected in the current drive period, a time interval from the immediately preceding discharge until the second droplet discharge pulse is compared with a threshold value, which is previously determined as a time interval at which a normal discharge can be performed based on the characteristics of ink in order to determine whether to select the second droplet discharge pulse. According to a result of determination, data is created to select the second droplet discharge pulse, or not select the second droplet discharge pulse.

Figure 11:
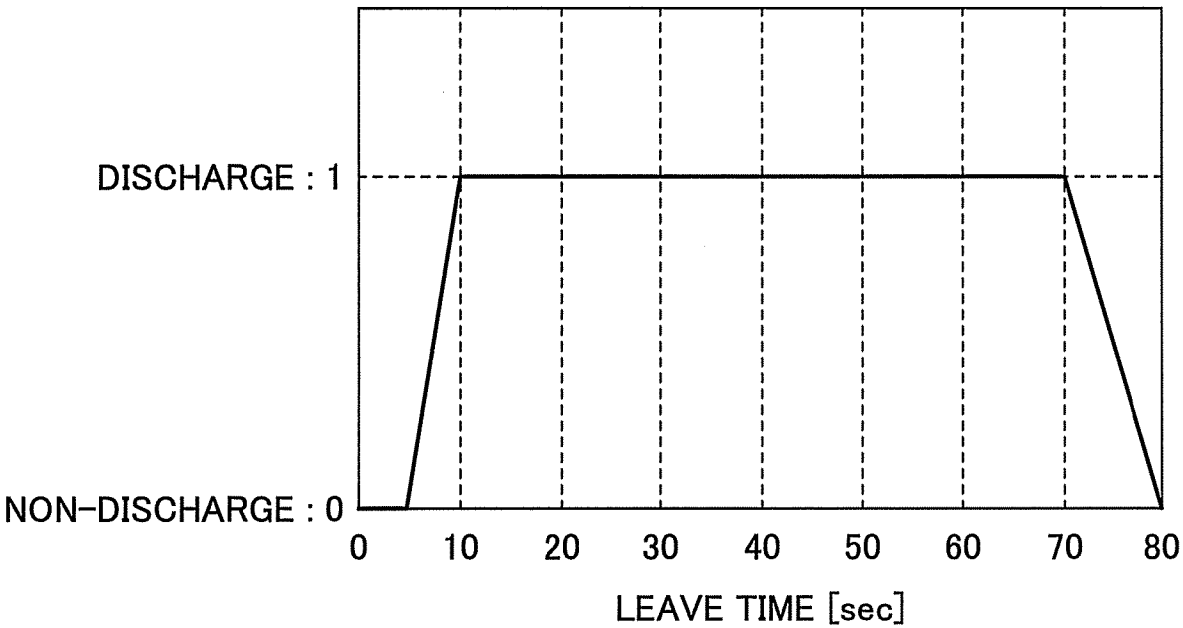
FIG. 11 is a graph illustrating a relationship between a leave time and discharge/non-discharge of ink used in the third embodiment.

Specifically, in the present embodiment, the ink discharged from the head has a characteristic as illustrated in FIG. 11. In FIG. 11, a horizontal axis represents a time period (leave time) from an immediately preceding discharge until a subsequent discharge, and a vertical axis represents whether to discharge (1) or not discharge (0) during a subsequent drive period or not discharge.

As illustrated in FIG. 11, the ink used in the present embodiment has a characteristic where the ink cannot be discharged when the leave time is very short but thereafter the ink can be discharged. Thus, in consideration of the characteristic of the ink, a pattern of applying the non-discharge pulse is created as illustrated in FIG. 10.

That is, if the time interval from the immediately preceding discharge until the subsequent discharge is within a time interval at which the ink can be normally discharged in the graph of FIG. 11, there is no need to perform the minute drive (that is, to apply the non-discharge pulse) immediately before the subsequent discharge. Thus, with respect to 4ch illustrated in FIG. 10, the non-discharge pulse is not applied during the drive period immediately before the final discharge. On the other hand, with respect to 3ch illustrated in FIG. 10, the non-discharge pulse is applied during the drive period T4 immediately before the final discharge because the time interval from the immediately preceding discharge until the subsequent discharge is short and the ink may not be discharged normally unless the non-discharge pulse is applied.

Here, the phrase "the ink may not be discharged normally" does not only mean that an ink droplet is not discharged at all (non-discharge) but also means a case where a speed and/or a volume of a droplet discharged are not within an appropriate range or a case where a direction of discharge (injection) is bent.

As mentioned above, when the second droplet discharge pulse is selected in the subsequent drive period, and neither the first droplet discharge pulse nor the second droplet discharge pulse is selected in the current drive period, a time interval from the immediately preceding discharge until the second droplet discharge pulse is compared with a threshold value, which is previously determined as a time interval at which a normal discharge can be performed in order to determine whether to select the second droplet discharge pulse. According to a result of the determination, whether to select or not select the second droplet discharge pulse is determined in order to attempt a further reduction in the power consumption while maintaining discharge stability.

Figure 12:
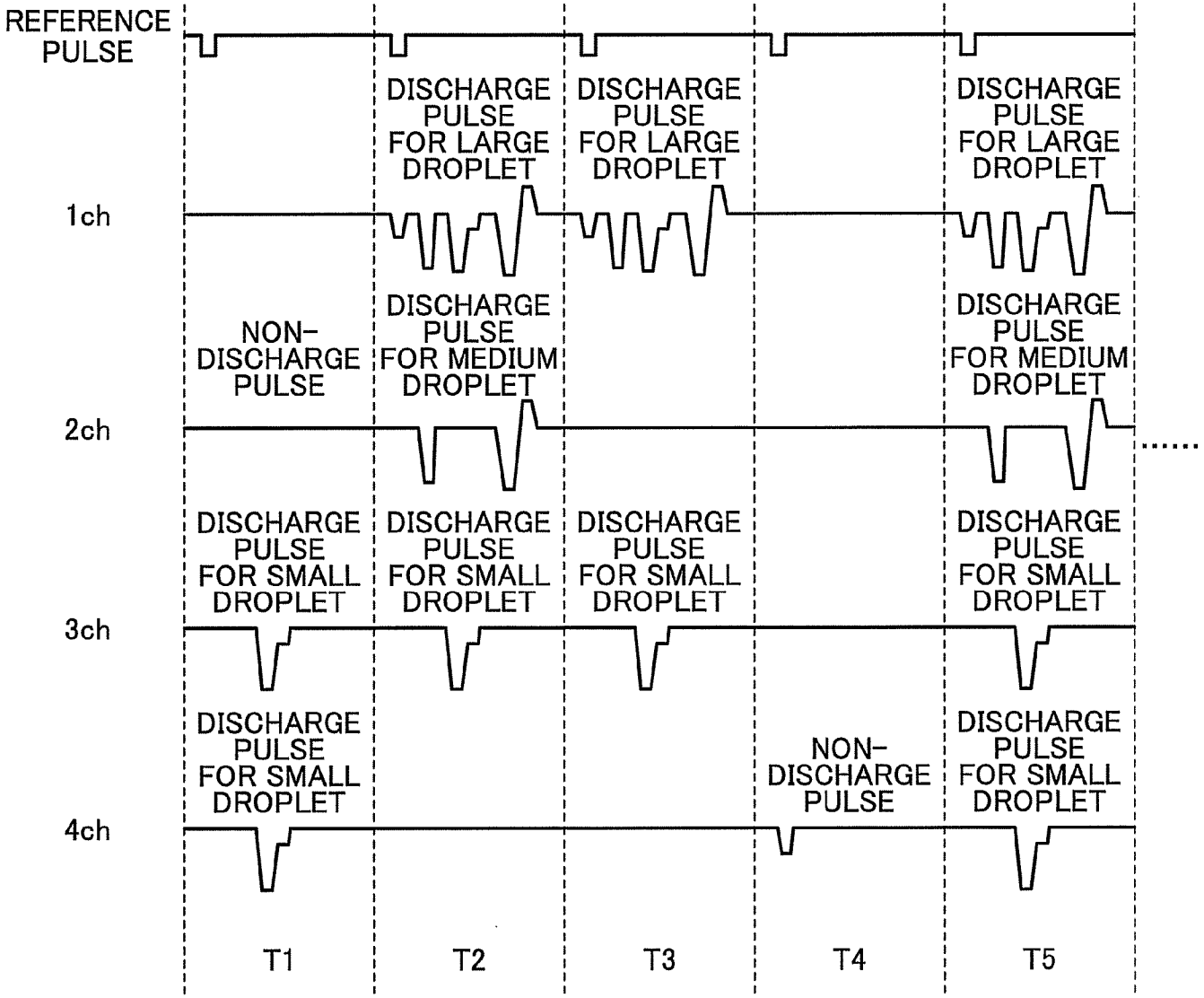
FIG. 12 is a waveform chart illustrating pulses applied in consecutive drive periods according to a fourth embodiment.

A description is given below, with reference to FIG. 12, of a fourth embodiment of the present invention.

In the present embodiment, with respect to 1ch, two discharge pulses for large droplet are applied consecutively (T2 and T3) and, thereafter, no discharge pulse is applied during the subsequent one drive period (T4), and, thereafter the discharge pulse for large droplet is applied in the subsequent drive period (T5). With respect to 2ch, the discharge pulse for medium droplet is applied (T2) and, thereafter, no discharge pulse is applied during the subsequent two drive periods (T3 and T4), and, thereafter the discharge pulse for medium droplet is applied in the subsequent drive period (T5). With respect to 3ch, three discharge pulses for small droplet are applied consecutively (T1, T2 and T3) and, thereafter, no discharge pulse is applied during the subsequent one drive period (T4), and, thereafter the discharge pulse for small droplet is applied in the subsequent drive period (T5). With respect to 4ch, the discharge pulse for small droplet is applied during the drive period (T1) and, thereafter, no discharge pulse is applied during the subsequent three drive periods (T2, T3 and T4), and, thereafter the discharge pulse for small droplet is applied in the subsequent drive period (T5).

In this embodiment, with respect to 3ch and 4ch, assuming that a current drive period is the drive period T4, the discharge pulse for small droplet, which is the second droplet discharge pulse, is applied during the subsequent drive period T5. At this time, although the non-discharge pulse is not applied during the drive period T4 immediately before discharging the last droplet in 3ch, the non-discharge pulse is applied during the drive period T4 immediately before discharging the last droplet in 4ch.

Here, similar to the above-mentioned third embodiment, if the time interval from the immediately preceding discharge until the subsequent discharge is within a time interval at which the ink can be normally discharged, the non-discharge pulse is not applied immediately before the subsequent discharge, and if the time interval is not within the time interval at which the ink can be normally discharged, the non-discharge pulse is applied immediately before the subsequent discharge.

Figure 13:
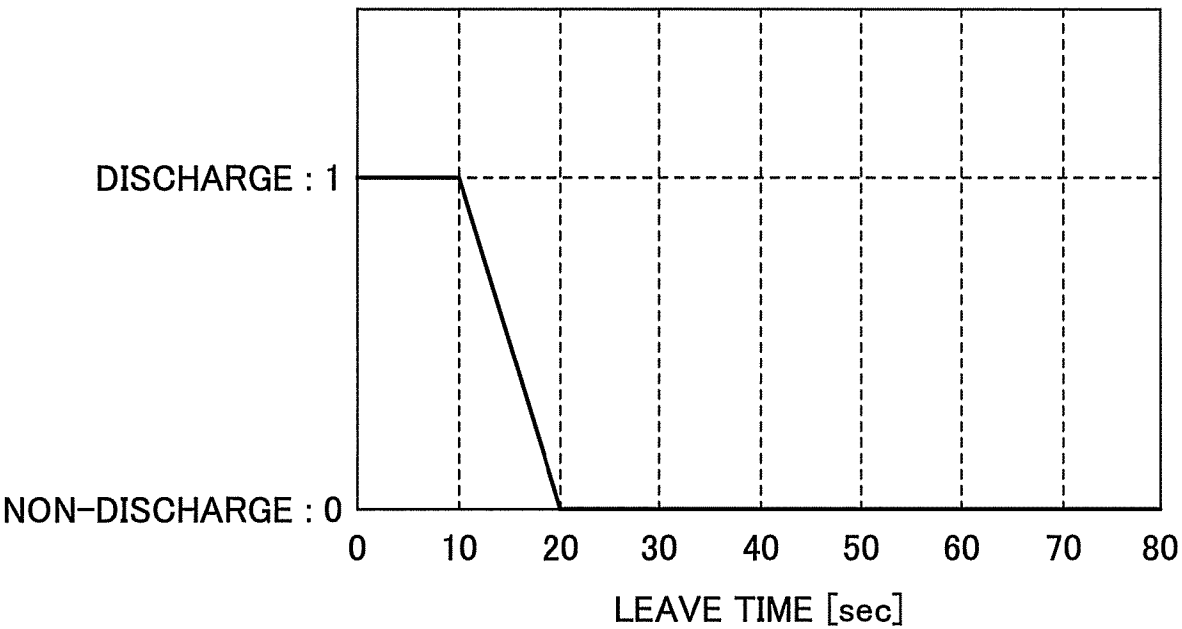
FIG. 13 is a graph illustrating a relationship between a leave time and discharge/non-discharge of ink used in the fourth embodiment.

Specifically, in the present embodiment, the ink discharged from the head has a characteristic as illustrated in FIG. 13. The ink used in the present embodiment has a characteristic where the ink can be discharged normally if the leave time from the immediately preceding discharge to the subsequent discharge is a relatively short time period, but when the leave time is long, the ink cannot be discharged normally. Thus, as illustrated in FIG. 12, with respect to 3ch, the non-discharge pulse is not applied because the time interval from the immediately preceding discharge to the subsequent discharge is short and normal discharge can be performed. On the other hand, with respect to 4ch, the non-discharge pulse is applied because the time interval from the immediately preceding discharge to the subsequent discharge is long and normal discharge cannot be performed without performing a minute drive.

In the third and the fourth embodiments, because the characteristic of the ink (a range where a normal discharge can be performed with respect to the leave time) depends on a type of ink, it is desirable to, for example, set a threshold value at which normal discharge can be performed for each color of ink (Y, M, C and K).

The creation of data to add the non-discharge pulse in the above-mentioned embodiments may be caused to be performed by the CPU 501 according to a program stored in the ROM 502 or the like. Such a program may be stored in a recording medium such as a magnetic hard disk, an optical disc, a memory card, etc, and the program is read from the recording medium by, for example, the reader 507 illustrated in FIG. 5, and is loaded to the RAM 503 when it is used by the CPU 501. Alternatively, such a program may be downloaded through a network such as the Internet. Additionally, the data to add the non-discharge pulse may be added to image data to be transferred to the image forming apparatus, when creating the image data by the printer driver 601 (program) of the host 600 (information processing apparatus), in order to transfer the thus-created data to the image forming apparatus.

The image processing apparatus according to the present invention is not limited to a serial-type image forming apparatus, and the present invention is applicable also to the line-type image forming apparatus.

The present invention is not limited to the specifically disclosed embodiments, and variations and modifications may be made without departing from the scope of the present invention.

The present application is based on Japanese priority applications No. 2010-207441 filed on Sep. 16, 2010 and No. 2011-157277 filed on Jul. 16, 2011, the entire contents of which are hereby incorporated herein by reference.

What is claimed is:

1. An image forming apparatus comprising:

a recording head having a nozzle to discharge a liquid droplet;

a drive waveform creation part configured to create and output a drive waveform containing a first pulse and a second pulse on an individual drive period basis, the first pulse causing the liquid droplet to be discharged from said nozzle, the second pulse causing a liquid in said recording head to flow within said recording head without causing the droplet to be discharged; and a data creation part configured to create data to select a first droplet discharge pulse or a second droplet discharge pulse when causing said recording head to discharge the liquid droplet, the first droplet discharge pulse containing said first pulse and said second pulse, said second droplet discharge pulse containing said first pulse but not containing said second pulse, wherein, when said first droplet discharge pulse or said second droplet discharge pulse is selected in a subsequent drive period and when neither said first droplet discharge pulse nor said second droplet discharge pulse is selected in a current drive period, said data creation part selects said second pulse in the current drive period when selecting said second droplet discharge pulse in the subsequent drive period, and does not select said second pulse in the current drive period when selecting said first droplet discharge pulse in the subsequent drive period.

2. The image forming apparatus as claimed in claim 1, wherein, when said first droplet discharge pulse or said second droplet discharge pulse is selected in a previously determined number of consecutive drive periods before the current drive period, said data creation part creates the data to not select said second pulse even when said second droplet discharge pulse is selected in the subsequent drive period.

3. The image forming apparatus as claimed in claim 1, wherein an amount of a liquid droplet discharged according to said first droplet discharge pulse is larger than an amount of a liquid droplet discharged according to said second droplet discharge pulse.

4. An image forming apparatus comprising:

a recording head having a nozzle to discharge a liquid droplet;

a drive waveform creation part configured to create and output a drive waveform containing a first pulse and a second pulse on an individual drive period basis, the first pulse causing the liquid droplet to be discharged from said nozzle, the second pulse causing a liquid in said recording head to flow within said recording head without causing the droplet to be discharged; and a data creation part configured to create data to select a first droplet discharge pulse or a second droplet discharge pulse when causing said recording head to discharge the liquid droplet, the first droplet discharge pulse containing said first pulse and said second pulse, said second droplet discharge pulse containing said first pulse but not containing said second pulse, wherein, when said second droplet discharge pulse is selected in a subsequent drive period and when neither said first droplet discharge pulse nor said second droplet discharge pulse is selected in a current drive period, said data creation part compares a time interval, which is from an immediately preceding discharge until said second droplet discharge pulse following the immediately preceding discharge, with a threshold value previously determined as a time interval by which a normal discharge is performed, and determines whether to select said second pulse based on a result of comparison in order to create data to select said second pulse or not select said second pulse in accordance with said result of comparison.

5. The image forming apparatus as claimed in claim 4 wherein said threshold value is determined for each type of the liquid to be discharged.

6. A computer readable recording medium storing a program for causing a computer to perform a process of creating image data to be output by an image forming apparatus, the image forming apparatus comprising:

a recording head having a nozzle to discharge a liquid droplet;

a drive waveform creation part configured to create and output a drive waveform containing a first pulse and a second pulse on an individual drive period basis, the first pulse causing the liquid droplet to be discharged from said nozzle, the second pulse causing a liquid in said recording head to flow within said recording head without causing the droplet to be discharged; and a data creation part configured to create data to select a first droplet discharge pulse or a second droplet discharge pulse when causing said recording head to discharge the liquid droplet, the first droplet discharge pulse containing said first pulse and said second pulse, said second droplet discharge pulse containing said first pulse but not containing said second pulse, wherein, when said first droplet discharge pulse or said second droplet discharge pulse is selected in a subsequent drive period and when neither said first droplet discharge pulse nor said second droplet discharge pulse is selected in a current drive period, the process causing said data creation part to select said second pulse in the current drive period when selecting said second droplet discharge pulse in the subsequent drive period, and not select said second pulse in the current drive period when selecting said first droplet discharge pulse in the subsequent drive period.

7. A computer readable recording medium storing a program for causing a computer to perform a process of creating image data to be output by an image forming apparatus, the image forming apparatus comprising:

a recording head having a nozzle to discharge a liquid droplet;

a drive waveform creation part configured to create and output a drive waveform containing a first pulse and a second pulse on an individual drive period basis, the first pulse causing the liquid droplet to be discharged from said nozzle, the second pulse causing a liquid in said recording head to flow within said recording head without causing the droplet to be discharged; and a data creation part configured to create data to select a first droplet discharge pulse or a second droplet discharge pulse when causing said recording head to discharge the liquid droplet, the first droplet discharge pulse containing said first pulse and said second pulse, said second droplet discharge pulse containing said first pulse but not containing said second pulse, wherein, when said second droplet discharge pulse is selected in a subsequent drive period and when neither said first droplet discharge pulse nor said second droplet discharge pulse is selected in a current drive period, the process causing said data creation part to compare a time interval, which is from an immediately preceding discharge until said second droplet discharge pulse following the immediately preceding discharge, with a threshold value previously determined as a time interval by which a normal discharge is performed, and to determine whether to select said second pulse based on a result of comparison in order to create data to select said second pulse or not select said second pulse in accordance with said result of comparison.

* * * * *